US009217256B2

(12) United States Patent
Sladojevic

(10) Patent No.: US 9,217,256 B2
(45) Date of Patent: Dec. 22, 2015

(54) CONCRETE LIFTING ANCHORS

(76) Inventor: Robert Sladojevic, Cherry Gardens (AU)

( * ) Notice: Subject to any disclaimer, the term of this patent is extended or adjusted under 35 U.S.C. 154(b) by 0 days.

(21) Appl. No.: 13/806,178

(22) PCT Filed: Jun. 30, 2010

(86) PCT No.: PCT/AU2010/000829

§ 371 (c)(1),
(2), (4) Date: Dec. 21, 2012

(87) PCT Pub. No.: WO2011/006187

PCT Pub. Date: Jan. 20, 2011

(65) Prior Publication Data

US 2013/0139451 A1 Jun. 6, 2013

(51) Int. Cl.
*E04G 21/14* (2006.01)
*E04C 5/12* (2006.01)

(52) U.S. Cl.
CPC ..... *E04G 21/142* (2013.01); *E04G 21/147* (2013.01); *E04C 5/12* (2013.01)

(58) Field of Classification Search
CPC ..... E04G 21/147; E04G 21/142; B66C 1/666; E04C 5/12–5/127
USPC ..... 52/125.4, 699, 707
See application file for complete search history.

(56) References Cited

U.S. PATENT DOCUMENTS

| | | | | | |
|---|---|---|---|---|---|
| 2,724,165 | A * | 11/1955 | Peterson | 249/207 |
| 3,290,983 | A * | 12/1966 | Drinko et al. | 411/446 |
| 3,861,106 | A * | 1/1975 | Erhart | 52/166 |
| 4,173,856 | A * | 11/1979 | Fricker | 52/125.5 |
| 4,580,378 | A * | 4/1986 | Kelly et al. | 52/125.5 |
| 6,119,431 | A * | 9/2000 | Wakai | 52/745.2 |
| 6,502,362 | B1 * | 1/2003 | Zambelli et al. | 52/698 |
| 6,694,680 | B2 * | 2/2004 | Zambelli et al. | 52/125.2 |
| 7,111,432 | B2 * | 9/2006 | Hansort | 52/125.4 |
| 7,934,343 | B2 * | 5/2011 | Fletcher et al. | 52/125.5 |
| 8,413,400 | B2 * | 4/2013 | Mackay Sim | 52/576 |
| 2008/0196324 | A1 * | 8/2008 | Mackay Sim | 52/125.4 |
| 2009/0320386 | A1 * | 12/2009 | Mackay Sim | 52/125.4 |

FOREIGN PATENT DOCUMENTS

| | | | |
|---|---|---|---|
| AU | 2004200854 | A1 | 10/2004 |
| EP | 0908583 | B1 | 8/2001 |

* cited by examiner

*Primary Examiner* — Elizabeth A Plummer

(57) ABSTRACT

An edge lift anchor for a concrete product, the anchor having a head portion for coupling to lifting equipment and an anchoring portion, and a separate member mounted on the anchor and having integral legs extending to each side of the anchoring portion to increase the lifting capacity of the anchor. Alternatively or in addition, the separate member may provide a mounting for a tension bar to increase the lifting capacity. The invention also provides a support chair for retaining the edge lift anchor, together with an associated shear bar and tension bar if present.

7 Claims, 11 Drawing Sheets

CONCRETE LIFTING ANCHORS

The present invention relates to anchors for use in the lifting of cast concrete products such as wall panels during the erection thereof. More particularly the invention relates to edge lift anchors.

In the fabrication of precast concrete wall panels either at an offsite casting yard or onsite, it is necessary to lift the panel from the horizontal configuration in which it is cast to a vertical configuration for transportation and/or erection. For offsite casting and for some onsite casting, lifting of the panel takes place from the edge of the panel which is the upper edge in the erected condition of the panel. For this purpose so-called edge lift anchors are incorporated into the reinforcing structure of the panel prior to casting. During casting the head of the anchor is encased within a removable or disposable void former to form within the edge surface of the panel a recess within which the head of the anchor lies for releasable coupling to lifting equipment.

Various forms of edge lift anchor are currently available. When the panel is being lifted when in its vertical configuration, the edge lift anchors must take the entire weight of the panel and edge lift anchors are appropriately sized for this purpose. Typically, the anchors are produced in a range of load carrying capacities from 2 tonne to 10 tonne, with anchors of appropriate capacity being selected for each particular job. For an anchor of given type and size, its load carrying capacity can be increased by the incorporation of an aperture beneath the head of the anchor to receive a tension bar which is a length of reinforcing bar which passes through the aperture and is bent to extend on either side of the body of the anchor to increase its effective depth of embedment relative to the upper edge of the panel. Incorporation of the tension bar may sometimes be relatively time consuming. Moreover when the tension bar is installed a primary potential failure mode when under load is a shearing or guillotine action between the bar and the opposite edges of the aperture in the anchor through which the bar passes. To avoid such failure the cross-sectional dimension of the bar is such as to provide a significant factor of safety and this does mean that the size of the bar is greater than that which is really necessary to increase the load carrying capacity of the anchor.

One aspect of the present invention relates to alternative means for increasing the load carrying capacity of the anchor to avoid these difficulties. Other aspects of the invention relate to alternative tension bar mounting configurations which result in increased versatility.

According to one aspect of the invention there is provided an edge lift anchor for a concrete product, the anchor having a head portion for coupling to lifting equipment and an anchoring portion, and a separate member mounted on the anchor and having integral legs extending to each side of the anchoring portion to increase the lifting capacity of the anchor.

In a preferred embodiment, the separate member is in the form of a collar mounted on the head of the anchor.

Advantageously, the collar includes an aperture for optional receipt of a tension bar to further increase the lifting capacity of the anchor.

According to a further aspect of the invention there is provided an edge lift anchor for a concrete product, the anchor having a head portion for engagement with lifting equipment and an anchoring portion, and a separate member mounted on the anchor, the member having an aperture for receipt of a tension bar to increase the lifting capacity of the anchor.

Yet another aspect of the invention provides an assembly comprising an edge lift anchor for a concrete product mounted to a support chair for installation on a casting base, the chair having provision for locating a shear bar associated with the anchor and a tension bar if present.

Embodiments of the invention will now be described by way of example only with reference to the accompanying drawings in which.

Figure 1:
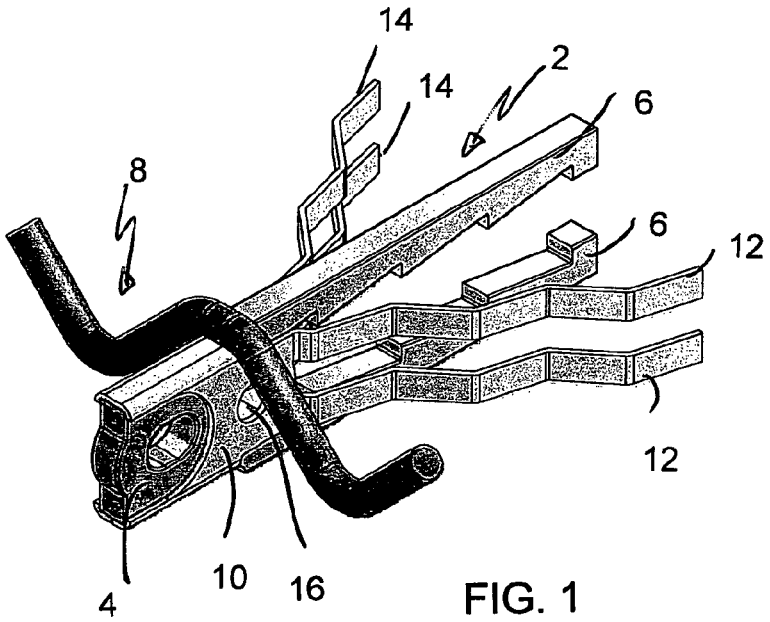
FIG. 1 is a perspective view showing an edge lift anchor to which is applied a collar in accordance with a first embodiment of the invention.
Figure 2:
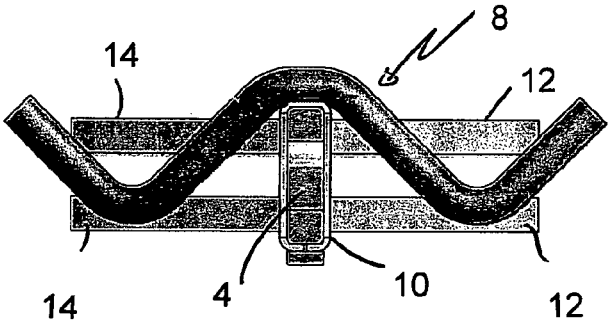
FIG. 2 is an end view.
Figure 3:
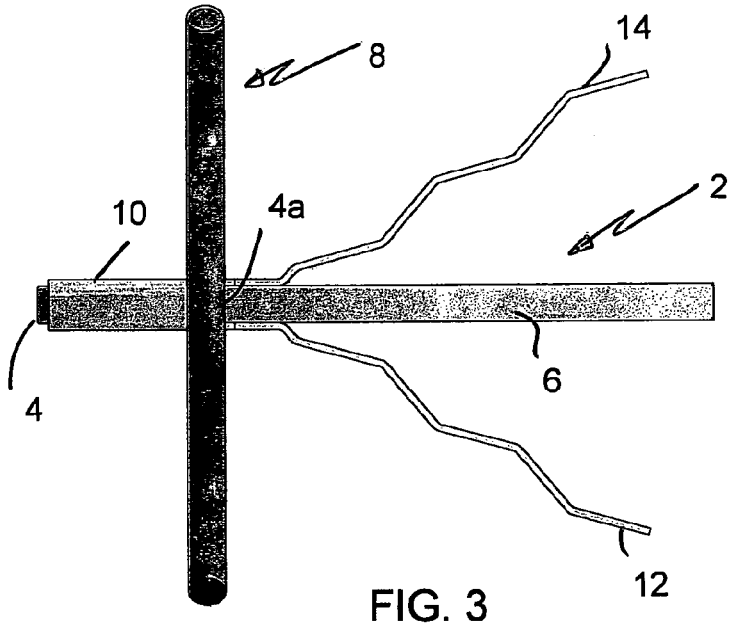
FIG. 3 is a plan view.
Figure 4:
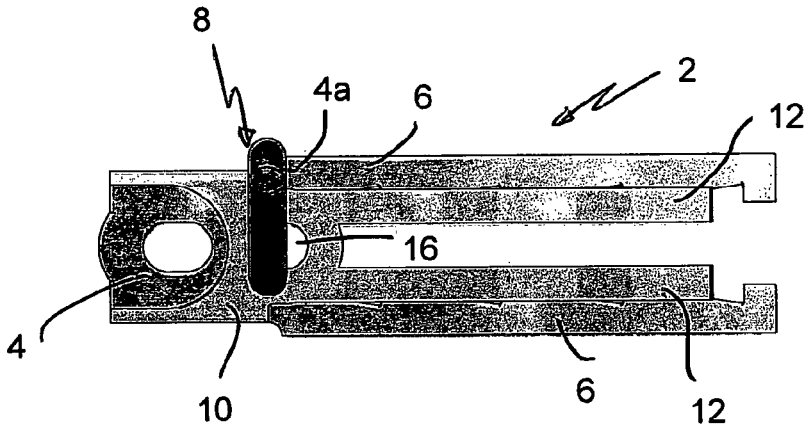
FIG. 4 is a side view.
Figure 5:
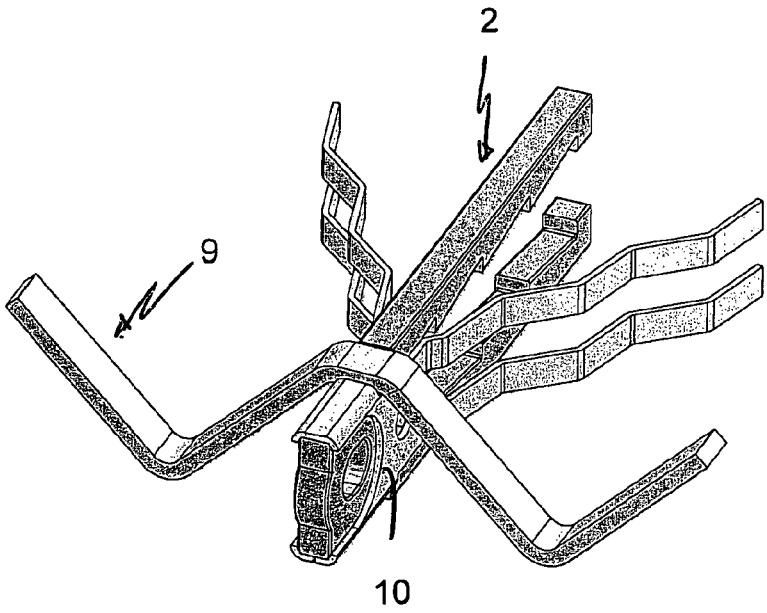
FIGS. 5 to 8 are views corresponding to FIGS. 1 to 4 but showing the collar used in conjunction with a shear bar of flat cross-section.
Figure 6:
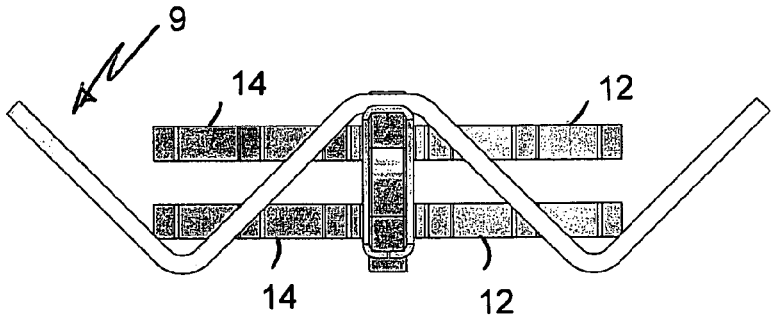
Figure 7:
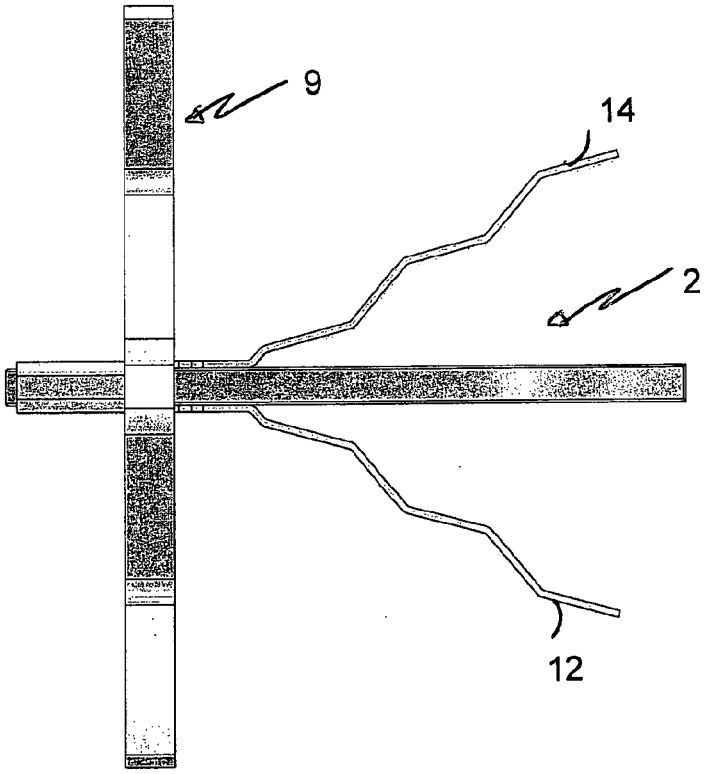
Figure 8:
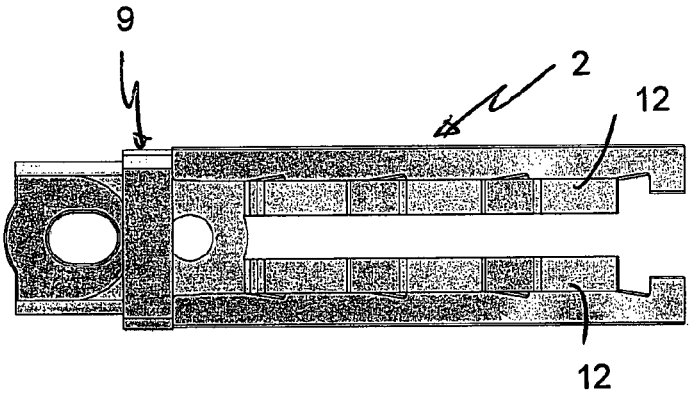
Figure 9:
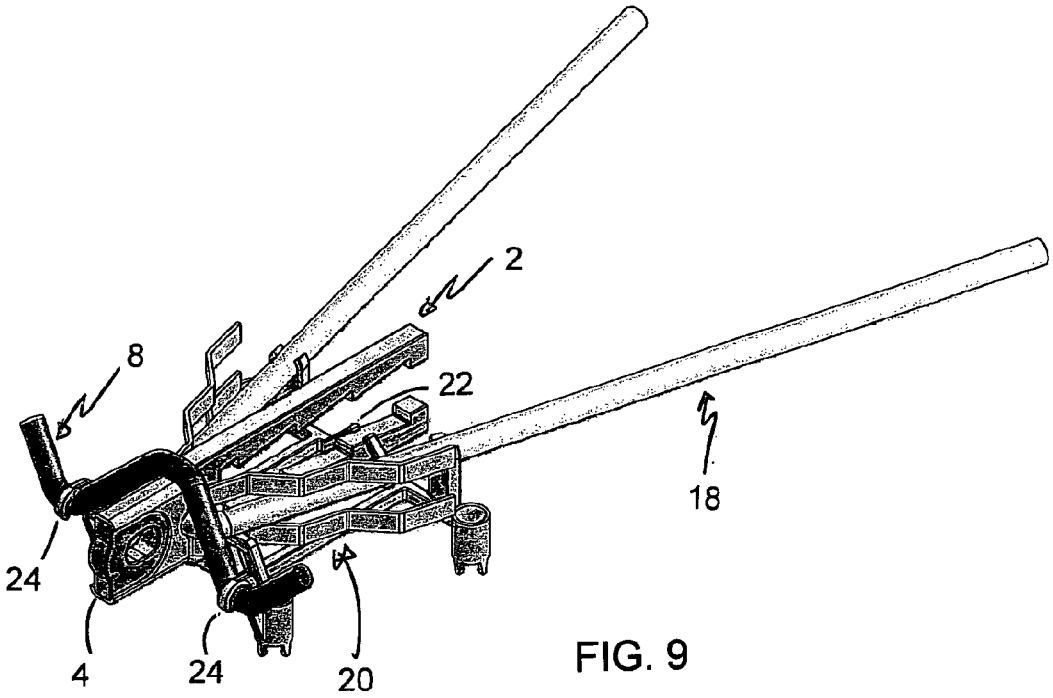
FIG. 9 is a perspective view showing the anchor with collar of FIGS. 1 to 4 mounted to a supporting chair together with an associated shear bar and tension bar.
Figure 10:
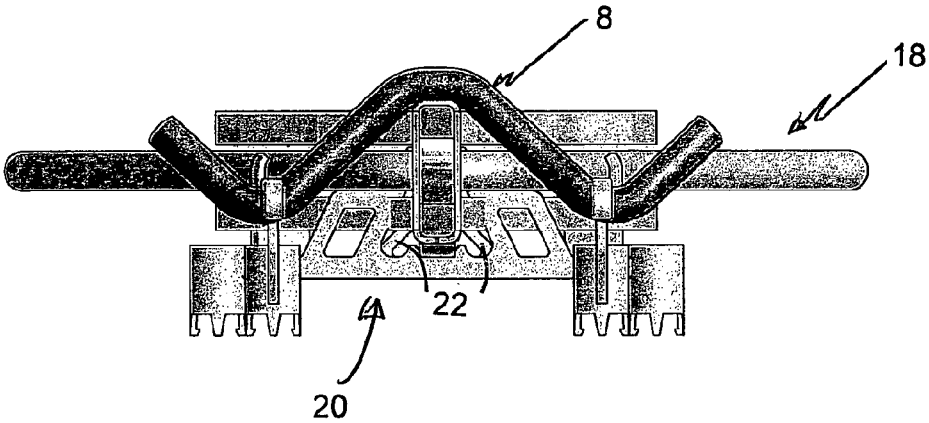
FIG. 10 is an end view.
Figure 11:
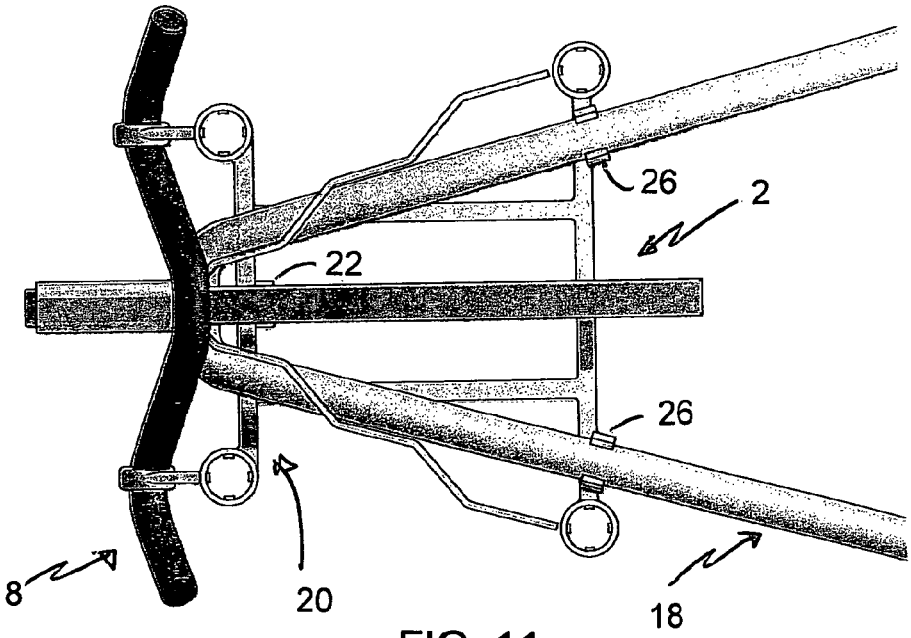
FIG. 11 is a plan view.
Figure 12:
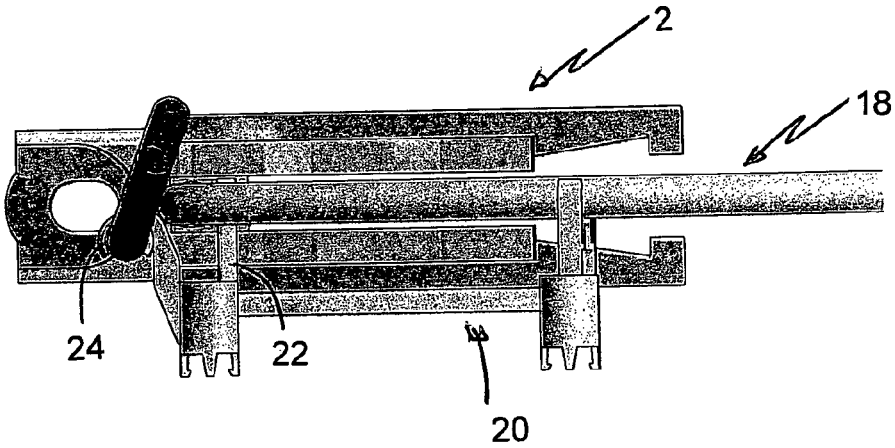
FIG. 12 is a side view.

FIGS. 1 to 4 show an edge lift anchor 2 in its installed position for lifting of the panel from its casting configuration in which the upper face of the panel is horizontal. The anchor has a head 4 for coupling to lifting apparatus, and an anchoring portion in the form of a pair of substantially parallel legs 6 extending from the head 4. The particular head 4 shown is designed for cooperation with a lifting clutch in the form of a ring clutch and an arcuate locking bolt received within the eye of the head, although it is to be understood that the head could be of a different detailed design for use with other types of lifting apparatus. The legs 6 are profiled along their inner edges with a saw tooth profile so as to lock into the surrounding concrete but it is to be understood that the legs may have any other form of profile to achieve that purpose.

The anchor of the general type shown is formed from thick metal plate by cutting and/or pressing techniques as will be well understood by persons skilled in the art. It is orientated in the panel in its casting configuration with an upper edge substantially parallel to the upper face of the panel. In the embodiment shown, the head 4 of the anchor is stepped inwardly relative to the anchoring portion, the step being designated 4*a* in the drawings. A metal shear bar 8 engages the upper edge of the head 4 adjacent the step 4*a* as is clearly shown in FIGS. 1 and 4. The shear bar 8 is provided to resist the shear loading which arises at the commencement of edge lifting when the panel is in its horizontal configuration following casting, as is well known. As shown, the shear bar 8 is formed from a length of reinforcing bar of substantially circular cross-section although it may alternatively be of flat cross-section as disclosed in our co-pending application of even date (Reference no. 30718060). This is shown in FIGS. 5 to 8 where the shear bar is designated 9.

The head 4 carries a metal collar 10 which is formed separately from the anchor and is applied to the head following manufacture of the anchor. The collar 10 includes pairs of integral legs 12, 14 each extending to respective sides of the anchor. The legs 12, 14 are formed into a zigzag or meandering shape as shown in order to lock into the concrete and thereby to increase the lifting capacity of the anchor. The legs 12, 14 may however be shaped in a manner different to that illustrated in order to achieve the same effect. The incorporation of the collar with the integral legs 12, 14 enables an increase in the lifting capacity of the anchor to be obtained without the need to incorporate a tension bar. The respective legs 12, 14 of each pair are spaced above and below the longitudinal axis of the anchor and thus will lie above and below central reinforcement within the panel. Accordingly, the legs in this configuration will avoid interference with the central reinforcement as may occur with a conventional centrally located shear bar.

It will be seen that in this embodiment, the collar 10 incorporates an aperture 16 inwardly of the eye of the head 4 and thus beneath the eye in the lifting configuration of the anchor. While the presence of this aperture is preferred for reasons to be discussed, it is not essential. When present it enables the lifting capacity of the anchor to be further increased by the incorporation of a metal tension bar 18 passing through the aperture in the manner shown in FIGS. 9 to 12, with the end part of the tension bar 18 passing between the respective legs 12, 14 of each pair. If this tension bar is provided it is likely to be of much smaller diameter than conventional tension bars, due to the effect of the legs 12, 14 which themselves provide substantial increase in the lifting capacity of the anchor. FIGS. 9 to 12 also show the assembly of the anchor 2, shear bar 8 and tension bar 18 installed in a chair 20 for rapid installation on the casting base prior to casting of the panel. The chair 20 which is formed as a one-piece plastic moulding includes clips 22 for the anchor 2, clips 24 for the shear bar 8 and clips 26 for the tension bar 18. The clips 22, 24, 26 are resilient and engage their associated components with a snap action.

Figure 13:
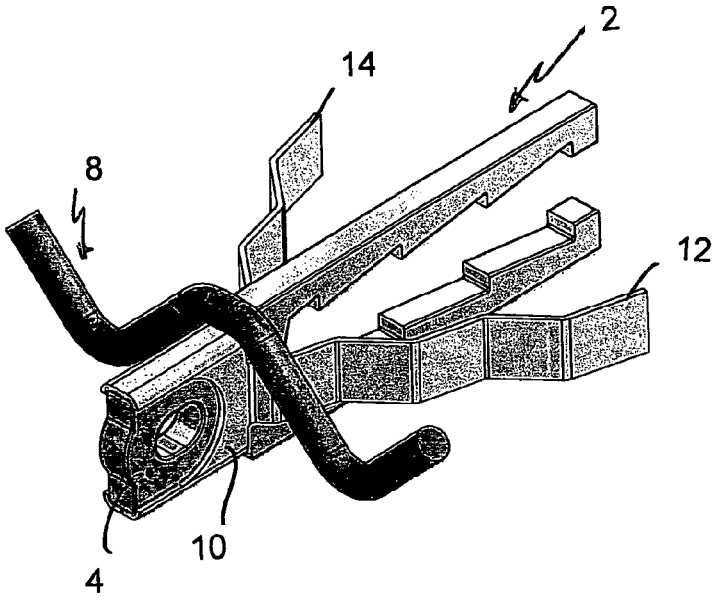
FIG. 13 is a perspective view similar to FIG. 1 but showing an alternative form of collar.
Figure 14:
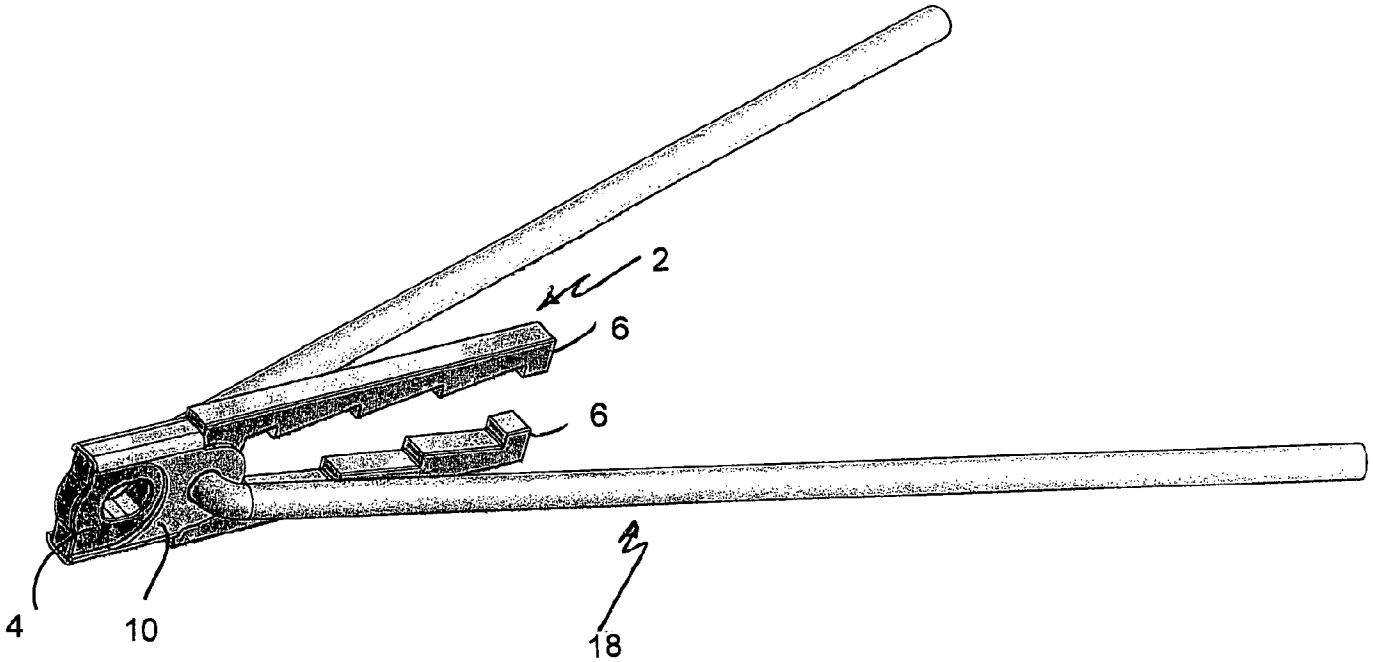
FIG. 14 is a perspective view similar to FIG. 1 but showing a further alternative form of collar.
Figure 15:
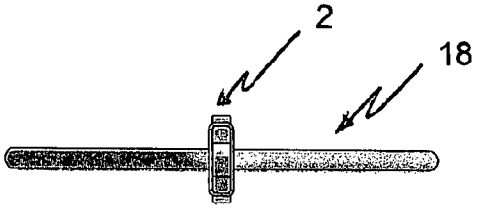
FIG. 15 is an end view.
Figure 16:
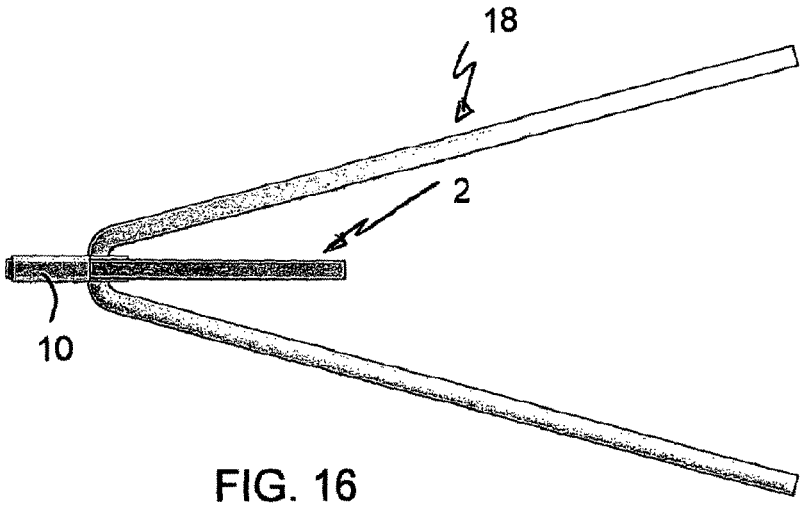
FIG. 16 is a plan view.
Figure 17:
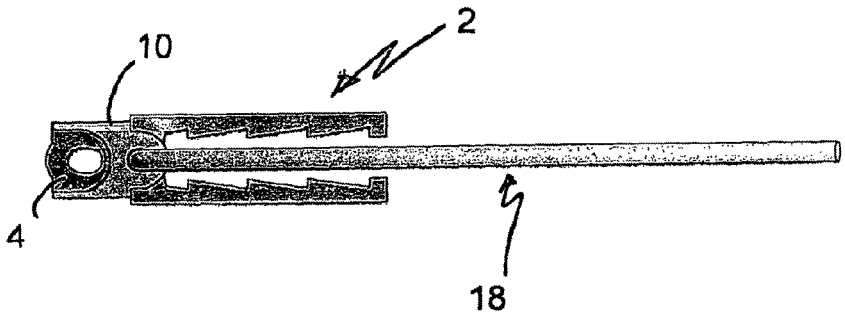
FIG. 17 is a side view.

In a variant shown in FIG. 13, the pairs of spaced legs at each side of the anchor are replaced by single legs 12, 14 of increased width. This version has particular utility in an arrangement where the panel has upper and lower reinforcement between which the legs will lie.

The legs 12, 14 (either as pairs of legs or single legs) increase the load carrying capacity of the anchor by acting in tension and not in shear. The failure mode will be tensile failure rather than shear failure which is the failure mode for conventional tension bars as discussed previously. The tensile strength is far greater than the shear strength and therefore the legs do not require the same cross-sectional area as that of a conventional tension bar and also do not require as deep an embedment within the concrete.

The incorporation of the collar with integral legs either with or without the aperture for the tension bar enables an anchor of basic form without the collar to be converted to an anchor of increased lifting capacity by application of the collar following manufacture and thereby the same anchor can be used for a range of different load applications either with or without the presence of the collar. This concept is applied in a somewhat different manner in the embodiment of FIGS. 14 to 17 in which the collar 10 is formed with the aperture 16 for receipt of a tension bar 18, but without the integral legs 12, 14 whereby an anchor of basic form can readily be converted into an anchor for use with a tension bar by mounting of the collar thereon.

Although the collar with integral legs has applicability to a wide range of anchors including those where the anchoring portion is formed other than by parallel legs (for example, an anchoring portion of solid plate-like form) it will be understood that those versions where the collar is provided with an aperture for receipt of a tension bar are essentially confined to use with anchors of the type having parallel legs to thereby permit passage of the tension bar from one side of the anchor to the other between the legs.

Figure 18:
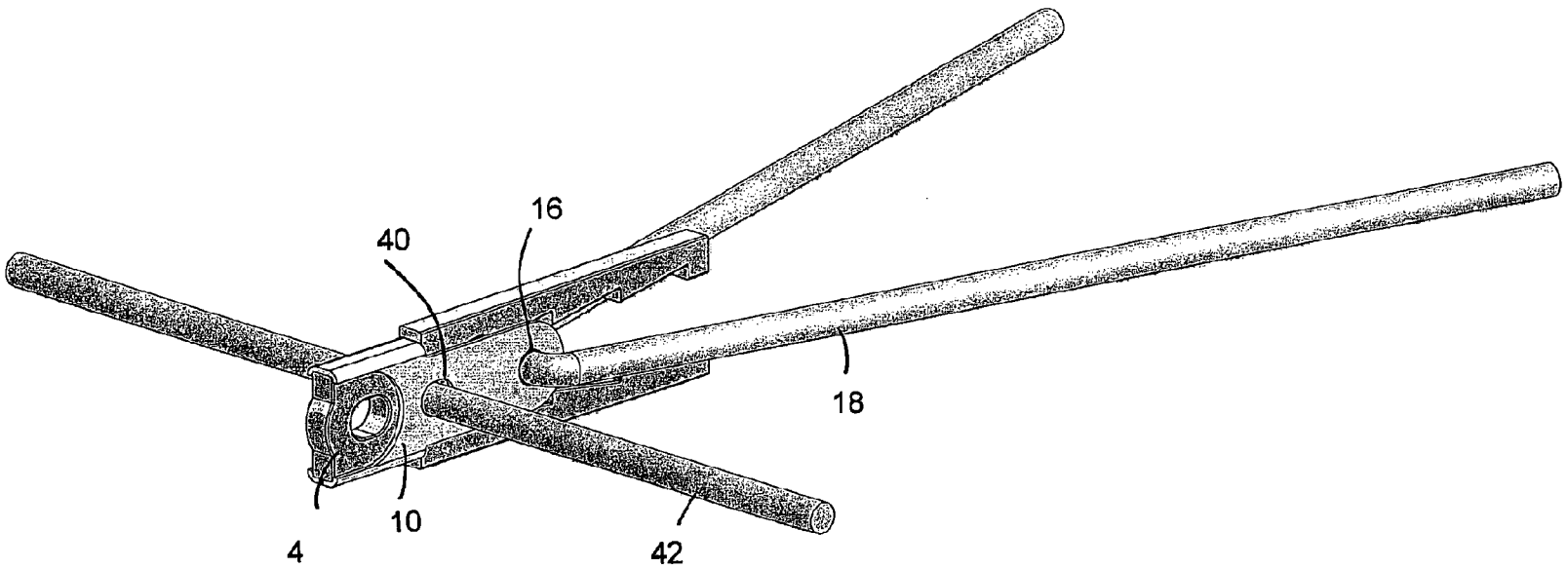
FIG. 18 is a perspective view similar to FIG. 1 but showing a yet further alternative form of collar.
Figure 19:
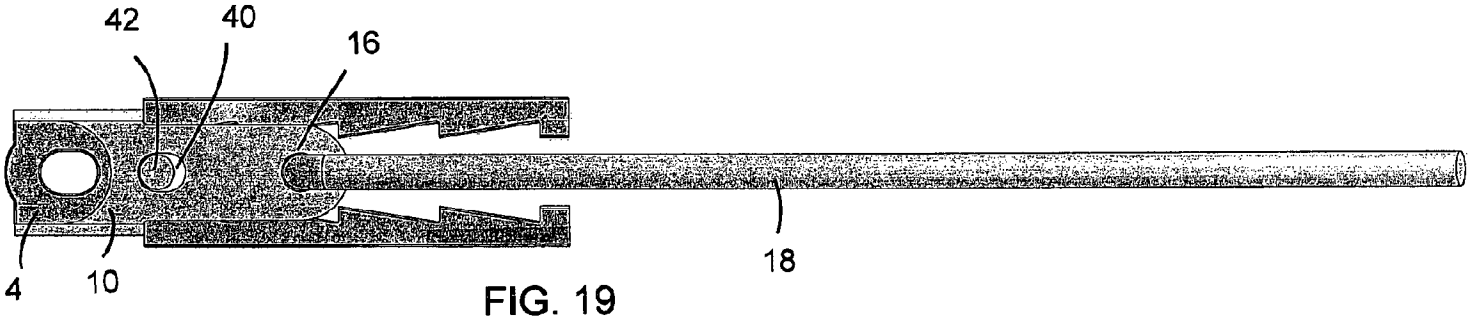
FIG. 19 is a side view.
Figure 20:
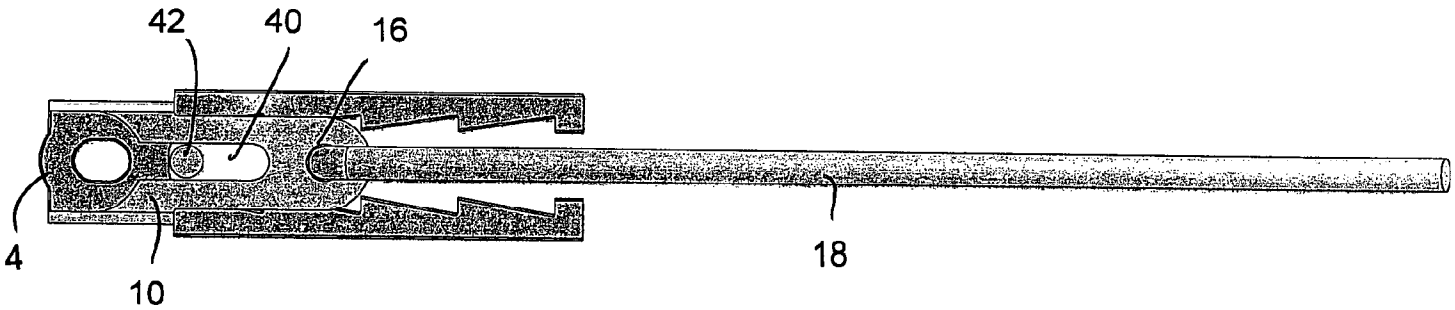
FIG. 20 is a side view showing a variant of the embodiment of FIGS. 18 and 19.

When the collar is formed with an aperture for receipt of a tension bar, the collar can be made of increased length so that the tension bar is positioned further away from the head of the anchor and thereby embedded deeper within the depth of the panel without increasing the length of the bar. Moreover this provision to vary the position of the tension bar enables the tension bar to be moved away from interference with heavy concentrations of steel reinforcement which may be at the top of the panel in some situations. FIGS. 18 and 19 show the collar 10 of such a length that aperture 16 for tension bar 18 is positioned a significant distance from the head 4, as shown approximately midway along the length of the anchor. FIGS. 18 and 19 also show the collar with a further aperture 40 between the head 4 and aperture 16 for a metal splice bar 42 to accommodate splicing of a perimeter bar of the reinforcement, the tension bar 18 being positioned beneath and thus away from the reinforcement, FIG. 20 shows a variant of this concept in which the aperture 42 is of elongate form to permit substantial variation in the positioning of the splice bar 42.

It is to be noted that the use of the collar 10 with aperture 16 for a tension bar provides significant versatility in the location of the tension bar which is not achievable in an arrangement in which the tension bar passes directly through the head of the anchor.

The embodiments are described by way of example only and modifications are possible within the scope of the invention.

The claims defining the invention are as follows:

1. An edge lift anchor for a concrete product, the anchor having a main portion comprising:

(i) a head portion for coupling to lifting equipment and (ii) an anchoring portion comprising two legs profiled along inner opposing edges with a saw tooth profile so as to lock into the surrounding concrete upon application of a lifting force along a longitudinal axis of the anchor, and a separate member fabricated from a sheet material being mounted on the anchor and having oppositely oriented integral legs extending to each side of the anchoring portion, wherein each of the integral legs is (a) profiled along an inner face thereof to have at least one corner or bend and (b) is oriented to present a broad face to the lifting force along the longitudinal axis of the anchor so as to lock into the surrounding concrete upon application of the lifting force along the longitudinal axis of the anchor, wherein, the legs of the anchoring portion and the integral legs of the separate member are configured so as to act cooperatively to lock into the surrounding concrete, and to be placed in tension upon application of the lifting force along the longitudinal axis of the anchor such that the failure mode of the anchor is more tensile failure than sheer failure.

2. An edge lift anchor according to claim 1, wherein the integral legs are of a meandering shape.

3. An edge lift anchor according to claim 1, wherein the integral legs are spaced on opposite sides of the longitudinal axis of the anchor.

4. An edge lift anchor according to claim 1, wherein the separate member has an aperture for receipt of a tension bar.

5. An edge lift anchor according to claim 4, wherein the aperture is provided within a collar portion of the separate member mounted to the head portion of the anchor.

6. An edge lift anchor according to claim 4, in combination with a tension bar engaged within the aperture, the tension bar having divergent legs.

7. An edge lift anchor according to claim 1, wherein the separate member is applied to the anchor by engagement of a collar portion of the separate member with the head portion of the anchor.

* * * * *